United States Patent [19]

Frechtman

[11] 4,058,283

[45] Nov. 15, 1977

[54] CONVERTIBLE PICTURE FRAME STAND

[76] Inventor: Jean Frechtman, 400 E. 56th St., New York, N.Y. 10022

[21] Appl. No.: 687,535

[22] Filed: May 18, 1976

[51] Int. Cl.[2] ..... A47F 7/14

[52] U.S. Cl. ..... 248/441 D; 248/470

[58] Field of Search ..... 248/126, 441 D, 442, 248/451, 453, 470, 473, 474

[56] References Cited

U.S. PATENT DOCUMENTS

| | | | |
|---|---|---|---|
| 270,130 | 1/1883 | Roeder | 248/470 |
| 1,257,159 | 2/1918 | Wachter | 248/441 D X |
| 1,315,326 | 9/1919 | Palis | 248/126 X |
| 3,908,955 | 9/1975 | Frechtman | 248/470 |
| D. 118,443 | 1/1940 | Fisk et al. | 248/441 D X |

FOREIGN PATENT DOCUMENTS

| | | | |
|---|---|---|---|
| 515,376 | 8/1955 | Canada | 248/470 |

*Primary Examiner*—William H. Schultz
*Attorney, Agent, or Firm*—Gottlieb, Rackman & Reisman

[57] ABSTRACT

An improved support arrangement for framed pictures, having a more secure easel-type stand which establishes an appropriate display angle for the picture. The stand rests on a display surface and includes an inclined segment to accommodate the lower edge of the framed article in a firm and releasably secure position. This permits the article to be elevated from the display surface, and establishes a predetermined display angle as set by the stand itself. In an alternate embodiment, the display angle is established by contact between the upper arms of the stand and corresponding cut-outs in the hanging bracket attached to the framed article, thereby creating an internal stopping position for the stand.

4 Claims, 5 Drawing Figures

FIG. 1
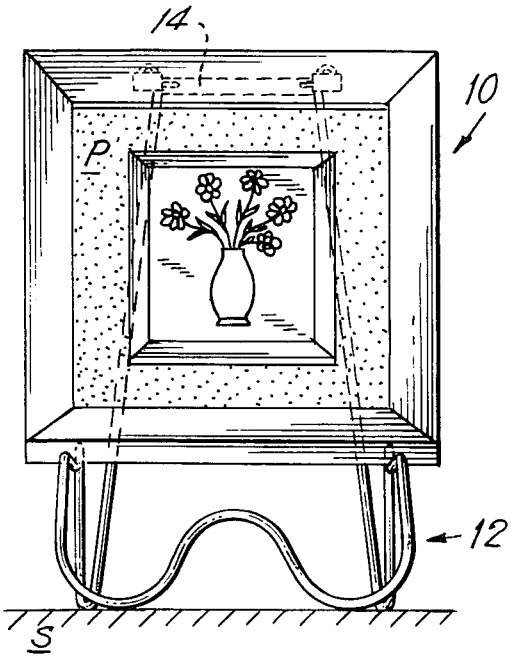
FIG. 5
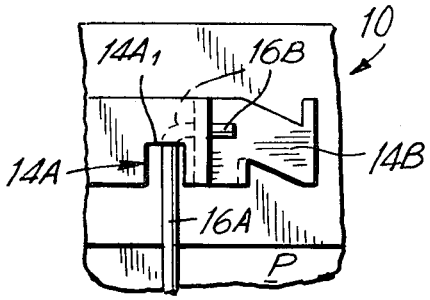
FIG. 2
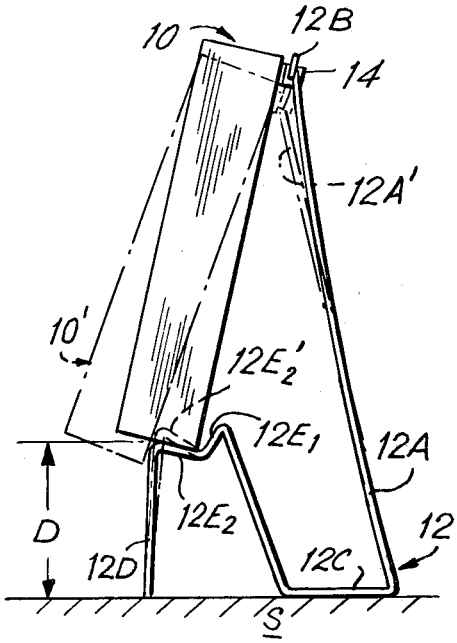
FIG. 3
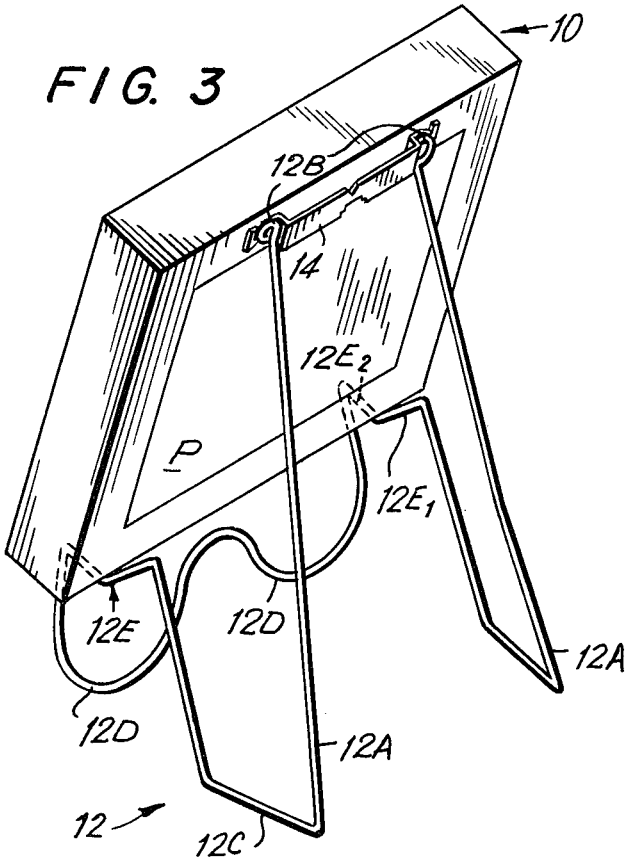
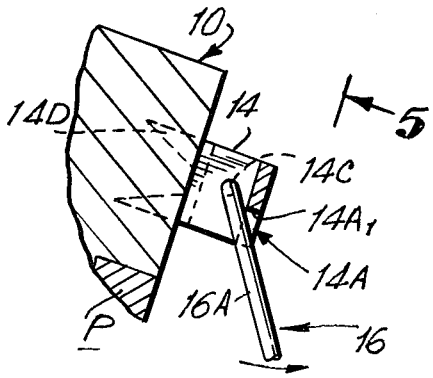
FIG. 4
5

CONVERTIBLE PICTURE FRAME STAND

This invention relates to supporting devices and more particularly, to devices for displaying and supporting framed articles such as pictures and photographs.

In the field of picture and photograph display, there have for some time been wide areas needing improvement, particularly with respect to versatile and interchangeable hangers and support members. It has also been needed to consider the development of aesthetically pleasing devices and secure stands or easels for the display of relatively small items. In my earlier U.S. Pat. No. 3,908,955, I disclosed an improved device which combined many desirable new features of a secure hanger, together with a companion and removable easel-type stand. In that patent, it was demonstrated that a good combination device could be realized with applications for multiple mode use.

But as pointed out in my subsequent application Ser. No. 615,214, filed Sept. 22, 1975 and co-pending herewith, there were some areas in which improvements were still desired. For example, the technique of coupling the stand to the hanger could be improved to permit heavier articles to be supported, and the stand could be made planar to avoid the necessity of removing it when changing from the standing to the hanging modes of display. The establishment of the display angle in the standing mode was also considered in that application, and while that problem was attended to by providing a self-contained "braking" system, this solution may not be completely satisfactory where it is important to protect the coupling between hanger and stand, and where greater internal security may be required.

In addition, another area which has received little or no attention from the prior art has been the combination of a stand with a device which establishes a fixed display position for the displayed article. Thus, prior art hanging or standing devices often permitted the article to support itself at the forward end on the display surface, with the stand providing the rearward support. This may be perfectly acceptable for larger framed articles, but it is often inappropriate for smaller ones. In attempting to use earlier structures for small articles the stand might prove to be too long and this could cause the arrangement to topple forward. Moreover, placing a smaller picture directly on the display surface tends to foreshorten it and lessen its visual impact.

It is therefore an object of this invention to obviate one or more of the aforesaid difficulties.

It is also an object of this invention to provide a more secure display arrangement for framed articles in a standing and hanging mode device.

It is a further object of this invention to furnish an internally secure arrangement for establishing the proper display angle for a standing article.

These and other objects and advantages of the invention will become apparent when a particular illustrative embodiment thereof is considered, wherein a combined hanger and supporting device is disclosed. The hanger bracket is affixed to the upper portion of the surrounding frame of the picture or photograph and serves as either a hanger for supporting the framed article on a wall, or as a securement arrangement for the upper attachment portion of the stand to be described below. In considering the standing mode of the invention, the upper arms of the stand are made of suitably resilient material, such as a spring metal and are accordingly biased towards each other so as to fit into apertures or other suitable receptacles on the opposed sides of the hanger bracket attached to the frame. The stand legs which descend from the bracket terminate in a generally flattened region which provides the rearward support for the article.

However, the forward support is provided not by the framed article itself, as in the prior art, but by a suitably formed support member of the stand of this invention. In particular, the support provided by the stand is generally aligned beneath the lower edge of the framed article to provide maximum support strength. This portion of the stand rests on the display surface and may consist, for example, of two generally curved support portions at either end of the lower edge of the framed portion, joined by an interconnecting upper loop. Above this support member is a pair of supporting ridges formed in the resilient material of the stand itself. One of these ridges is arrayed at either end of the framed article, and the ridge includes a forward leg connected to the underlying forward support loops of the stand and an upwardly inclined rear element which is connected to the rear support member of the stand. In its normal position when no framed article is presented for retention, the forward ledge of the ridge is in a slightly elevated position as there is no lower edge of a frame to depress it into the engaging position. However, when the framed article is presented by pressing its lower edge surface onto the ledge, this depresses the resilient material of the stand and causes the picture to "snap" into place with its lower surface in contact with the ledge and its rear surface held in place by the junction between the ledge and the upwardly inclined rear member. In this position, the framed article is held securely in place against most extraneous influences and presents a pleasing appearance as it is elevated from the display surface, much in the manner of a true artist's easel.

The angle of the stand of this picture is controlled, in another embodiment, by the interaction between the upper arms of the stand and members associated with the hanging bracket into which the arms are accommodated. The arms in this embodiment are again resiliently biased, illustratively away from each other, and they are compressed slightly in order to be received within apertures in the side walls of the hanging bracket. Once this insertion process has been completed, the framed article is pivoted forward and the upper arms of the stand make no contact with the edge of the bracket because of the use of cut-outs in the lower edge of the bracket corresponding to each of the upper arms of the stand. After the framed article and stand are pivoted away from each other, the stand arms ultimately contact the upper edge of their respective cut-outs, and this establishes the stopping position for the stand — it cannot pivot rearwardly any further. The angle of display, whereby the stand rests on the display surface and the framed article pivots forward to its display position, has thereby been established.

It is therefore a feature of an embodiment of this invention that a support arrangement is convertible between hanging and standing modes, with the standing mode having an elevating support member to raise the article above the display surface.

It is also a feature of an embodiment of this invention that a hanging bracket accommodates the stand and has internally located cut-outs for making contact with the stand arms to establish the standing display angle.

These and other objects, features and advantages of this invention will become more readily understood when considered in connection with a presently preferred, but nonetheless illustrative, embodiment of the invention as explained in the following detailed description and as shown in the accompanying drawing, wherein:

FIG. 1 is a front view of a framed article being displayed in elevated fashion from the display surface;

FIG. 2 is a side view of a framed article adapted to be elevated from the display surface, and showing as an auxiliary view the framed article withdrawn from the support stand;

FIG. 3 is a rear perspective view of the stand of this invention supporting the framed article in its elevated position on the display surface;

FIG. 4 is a fragmentary side sectional view of the contact between the stand and hanging member to establish the display angle in the alternative embodiment; and FIG. 5 is a fragmentary rear view of the contact between the stand and arms and bracket cut-outs, taken from the lines 5—5 of FIG. 4 in the direction of the arrows.

As indicated in FIGS. 1–3, an article such as picture P capable of being framed is shown contained within frame 10. The entire assembly is supported by stand 12 which is connected to frame 10 by means of hanging bracket 14, functioning in this instance in its connecting or coupling mode. Considering the details of FIGS. 2 and 3 particularly, it is noted that stand 12 includes legs 12A which proceed upwardly toward the top of frame 10 and terminate in attachment arms 12B which are accommodated within suitable apertures in hanging bracket 14. For support purposes, generally flattened region 12C at the rear of stand 12 provides the rearward support for the frame and stand assembly. The forward support is provided by curved members 12D at either side of the framed article. It is noted from a consideration of FIG. 2 that the support provided by members 12D is generally beneath the lower surface of frame 10, to provide maximum supporting strength.

The actual securement of framed article 10 in stand 12 is achieved by means of irregularly shaped element 12E of stand 12. As best viewed in FIG. 2, portion 12E includes a rearward and upwardly inclined wall $12E_1$, which connects with forward ledge $12E_2$. The precise angular relationship between elements $12E_1$ and $12E_2$ can be varied to accommodate frames of different thicknesses, and this will be apparent to those skilled in the art once this invention has been disclosed. As indicated in the view of FIG. 2, the frame at position 10′ has its rear surface resting against the upper edge of support elements 12D; at this time, the ledge $12E_2$ of element 12E is actually at the corresponding phantom position $12E_2'$.

In order for frame 10 to be securely retained by stand 12, the frame is pressed upwardly from the 10′ position such that the lower surface of frame 10 is substantially aligned with the upper surface of ledge $12E_2$. At that point, the frame may be urged to the rear, assuming the position illustrated in full line at 10 in FIG. 2. In order for this position to be reached, ledge $12E_2$ is slightly depressed, made possible by the resiliency of the material from which stand 12 is made. At the same time, the rear legs of stand 12 assume the corresponding full line position 12A having moved from position 12A′ in FIG. 2.

When the full line support positions shown in FIG. 2 have then been reached, the support arrangement illustrated in FIGS. 1 and 3 is achieved. Under these conditions, framed article 10 is held with reasonable security by stand 12, and the lower surface of frame 10 is both supported on ledge $12E_2$, with its forward edge projecting beyond the ledge, and is correspondingly elevated above display surface S by the distance D of support members 12D. This provides both a secure and pleasing visual arrangement.

In the alternative display embodiment represented by the views of FIGS. 4 and 5, frame 10 is in this case equipped with a stand identified as 16. The rear legs 16A of stand 16 are again biased, but as noted in FIG. 5 they may be biased outwardly rather than inwardly. The function of stand 16 in this embodiment can be appreciated by noting that hanging bracket 14 is provided with a pair of cut-outs 14A in its lower edge, corresponding generally to the position to be occupied by the upper portion of stand arms 16A. When upper stand attachment portions 16B are inserted in apertures 14C of the side walls of bracket 14, stand 16 may then be pivoted rearwardly before the final display angle controlled by the interaction of stand 16 and bracket 14 is achieved.

In its rearward pivoting action, the upper portion of stand arms 16A then contacts the upper edge $14A_1$ of cut-out 14A, as shown by the counterclockwise arrow and the limiting position in FIG. 4. At that point, stand arm 16A is limited from any further rearward pivoting about arm 16B rotating within aperture 14C. At the same time, as shown in FIG. 5, stand arm 16A is protected from disengagement, for example at 16B, except by the most deliberate act of removing arm 16B from aperture 14C. In the absence of this unlikely occurrence, it will be quite difficult for arm 16B to be dislodged because of the protection afforded to stand arm 16A by cut-out 14A.

The attachment of hanging bracket 14 to frame 10 is generally shown in FIGS. 4 and 5 and is comparable to that previously disclosed in my patent and pending application identified above. Relatively sharp prongs 14D penetrate into the rear surface of frame 10 and thereby achieve retention therein. Sideways support for bracket 14 is provided by zig-zag cut-out members 14B at opposite ends of bracket 14. When the stand member is removed, hanging bracket 14 is capable of supporting frame 10 in the hanging mode, as disclosed in my other inventions.

It is to be understood that the foregoing embodiments are merely illustrative of the application of the principles of this invention. Numerous variations may be devised by those skilled in the art without departing from the spirit or scope of the invention.

What is claimed is:

1. A device supporting an article having a frame comprising a stand element supporting said article in a first display mode above a display surface and a hanger element for supporting said article in a second display mode independently of said stand element and in said first display mode in conjunction with said stand element, said stand element including an upper resilient portion for attachment to said hanger element and a lower display portion comprising rear support means in contact with said display surface, forward support means in substantial alignment with said frame and in contact with said display surface, said rear support means comprising at least one leg member having a flattened portion in continuous contact with said display surface, and said forward support means comprising at least one looped element beneath said frame and having a lower arc portion in contact with said display surface, and frame engaging means connecting said forward and rear support means and having securement means for retaining said frame at a predetermined display angle to said display surface, said securement means comprising a first support element substantially transverse to the plane of said frame and adapted to be engaged under and in contact with said frame to exert an upward bias against said frame, and a second support element connected to said first support element and formed at a rearward oblique angle thereto to define a junction therebetween, said frame being accommodated on said first support element and against said upward bias thereof, and being retained against rearward movement by said junction, said hanger element including coupling means for receiving said upper resilient portion to establish said first display mode, and wherein said predetermined display angle is defined and established by the support of said frame by said flattened portion of said leg member and by said looped element after said frame is secured at said junction of said first and second support elements of said securement means and is retained at said angle under spring action of at least said first support element.

2. A device supporting an article having a frame comprising a stand element supporting said article in a first display mode on a display surface and a hanger element attached to said frame for supporting said article in a second display mode independently of said stand element and in said first display mode in conjunction with said stand element, said stand element including an upper resilient portion for attachment to said hanger element and a lower display portion in contact with said display surface, said hanger element including coupling means for receiving said upper resilient portion of said stand element in said first display mode and access means for defining a connection channel to said coupling means for said upper resilient portion, said access means including an edge surface of said hanger element to provide a limiting stop for said stand element in pivoting away from said article to establish said first display mode at a predetermined display angle.

3. A device in accordance with claim 2 wherein said upper resilient portion of said stand element includes at least one arm terminating in a connecting leg member, said coupling means includes at least one segment substantially transverse to said aricle and having an aperture to receive said leg member therein, and said access means includes a cut-out from said hanger element defining a pivoting arc from the plane of said article to the limiting position at said limiting stop whereby said predetermined display angle is established.

4. A device in accordance with claim 3 wherein said cut-out includes opposed substantially vertical edges terminating in said edge surface substantially parallel to said display surface, said substantially vertical surfaces being separated to accommodate said one arm of said stand element therebetween.

* * * * *